US010981397B2

(12) United States Patent
Dubuit

(10) Patent No.: US 10,981,397 B2
(45) Date of Patent: Apr. 20, 2021

(54) MACHINE FOR PRINTING A PLURALITY OF OBJECTS

(71) Applicant: Jean-Louis Dubuit, Paris (FR)

(72) Inventor: Jean-Louis Dubuit, Paris (FR)

(73) Assignee: MACHINES DUBUIT, Noisy le Grand (FR)

( * ) Notice: Subject to any disclaimer, the term of this patent is extended or adjusted under 35 U.S.C. 154(b) by 0 days.

(21) Appl. No.: 16/153,814

(22) Filed: Oct. 7, 2018

(65) Prior Publication Data

US 2019/0105925 A1 Apr. 11, 2019

(30) Foreign Application Priority Data

Oct. 9, 2017 (FR) ..... 1759431

(51) Int. Cl.

| | |
|---|---|
| ***B41J 3/407*** | (2006.01) |
| ***B41J 25/00*** | (2006.01) |
| ***B41J 11/00*** | (2006.01) |
| ***B41J 3/54*** | (2006.01) |

(52) U.S. Cl.

CPC ..... *B41J 3/40731* (2020.08); *B41J 3/4073* (2013.01); *B41J 3/543* (2013.01); *B41J 11/002* (2013.01); *B41J 25/001* (2013.01)

(58) Field of Classification Search

CPC ..... B41J 3/4073; B41J 3/543; B41J 11/002; B41J 25/001

See application file for complete search history.

(56) References Cited

U.S. PATENT DOCUMENTS

| | | | |
|---|---|---|---|
| 3,096,709 A | 7/1963 | Eldred et al. | |
| 3,521,296 A | 7/1970 | Schoeneman | |
| 8,201,904 B2 * | 6/2012 | Vesanto | B41J 3/4073 347/20 |
| 9,744,776 B2 * | 8/2017 | Moehringer | B05B 13/0235 |

FOREIGN PATENT DOCUMENTS

EP 2179853 A1 4/2010

OTHER PUBLICATIONS

French Patent Application No. 17 59431, INPI Rapport de Recherche Preliminaire, dated Jun. 5, 2018, 2 pages.

* cited by examiner

*Primary Examiner* — Geoffrey S Mruk
(74) *Attorney, Agent, or Firm* — Soquel Group LLC

(57) ABSTRACT

Machine for printing objects having outer surfaces to be printed, the machine including a frame, and at least two treatment units and a printing unit attached on the frame, the printing unit including at least one inkjet printhead suitable for ejecting inkjets along a printing direction, and a turret mounted rotating relative to the frame around a rotation axis, and including four object holders spaced regularly apart at 90° around the rotation axis, and suitable for holding the objects and rotating them around four object-holder axes perpendicular to the rotation axis, the turret being movable successively between four positions, at least one of the object holders being across from the printing unit in each of the positions, while two others of the object holders are across from the treatment units, the printing machine including a turret support with an adjustable incline around a pivot axis relative to the frame.

10 Claims, 3 Drawing Sheets

MACHINE FOR PRINTING A PLURALITY OF OBJECTS

CROSS REFERENCE TO RELATED APPLICATIONS

This application claims benefit priority of French Patent Application No. 17 59431 filed on Oct. 9, 2017.

FIELD OF THE INVENTION

The present invention relates to a printing machine for printing a plurality of objects having an outer surface to be printed, the printing machine including:

a frame, and at least two treatment units and at least one printing unit attached on the frame, the printing unit comprising at least one inkjet printhead suitable for ejecting inkjets along a printing direction, and for the inkjets to be aligned along an alignment direction perpendicular to the printing direction, and a turret mounted rotating relative to the frame around a rotation axis, and comprising at least four object holders spaced regularly apart at 90° around the rotation axis, and suitable for holding the objects and rotating the objects around four object-holder axes, the turret being movable successively between at least four positions relative to the frame, at least one of the object holders being across from the printing unit in each of the positions, while two others of the object holders are across from the treatment units.

The invention also relates to an assembly of such a printing machine and such a plurality of objects.

The invention lastly relates to a corresponding method.

BACKGROUND OF THE INVENTION

An inkjet printhead comprises rows of nozzles on its lower face. The spacing between each nozzle is equal to the definition, in dots per inch (DPI). The lower surface for example comprises four rows of ninety nozzles each. The two outermost rows are for example spaced apart by 2.82 mm, while the nozzles in the four rows are spaced apart by 0.0705 mm, which leads to a definition of 360 DPI.

The length of a row of nozzles is for example approximately 72 mm and the width of the lower surface is for example 17.2 mm. The width of the lower surface corresponds to the thickness of the printhead. The alignment direction of the inkjets extends in the direction of the length of the lower surface.

To print objects of revolution, it is known to orient the inkjets toward a generatrix of the object, and to rotate said object around its axis of revolution.

In the field of machines for printing on conical objects, it is known to act so as, at the printing unit, to tilt the object such that its upper generatrix is horizontal. This allows the printing means, in the case at hand a screenprinting frame, to be in a horizontal plane, and the ink located in the screenprinting frame to be distributed uniformly on the surface to be printed. This is a sign of good printing.

Thus, document U.S. Pat. No. 3,521,296 describes a machine having a main frame on which a second frame is attached comprising means for removing the object to be printed. This second frame may pivot relative to the main frame. In this way, by tilting the second frame with respect to the main frame, it is possible to tilt the axis of revolution of the conical objects relative to the horizontal. The objects are therefore all tilted below the various printing units and have an upper generatrix in a horizontal plane corresponding to the different planes of the printing screens.

It is also known, in the field of the direct printing of objects, to convey the objects to be decorated not using a linear conveyor, as described in the aforementioned document, but by a circular conveyor in the form of a rotating object-holder turret bringing the objects below the various printing units located tangentially relative to the circular trajectory of the turret. In this case, it is not possible to tilt the conveyor and cause the upper generatrixes of the conical objects to be in a horizontal plane. Indeed, due to the circular arrangement of the objects on the turret, only one of the objects has an upper generatrix in a horizontal plane. In this case, according to a technique described in U.S. Pat. No. 3,096,709, each object holder, and not only one of them, is tilted relative to the turret, as illustrated in FIG. 47 of this document.

However, such printing machines are complex and the inclines of the various object holders are delicate and very difficult to adjust, since each time the type of object to be printed changes, it is necessary to adjust each object holder identically to satisfy the precision required by the inkjet printing, which is about 0.035 mm.

One aim of the invention is therefore to offset all or part of the above drawback, by proposing a printing machine facilitating printing in particular on objects having an outer surface at least partly of revolution, in particular frustoconical or cylindrical.

SUMMARY OF THE DESCRIPTION

To that end, the invention relates to a printing machine as described above, in which:

the object holder axes are perpendicular to the rotation axis, the printing machine includes a turret support on which the turret is mounted rotating around the rotation axis, and the incline of the turret support is adjustable around a pivot axis relative to the frame, the pivot axis being, on the one hand, perpendicular to the object holder axis of the object holder located across from the printing unit, and, on the other hand, combined with the object holder axes of the other two object holders located across from the treatment units.

According to particular embodiments, the printing machine comprises one or more of the following features, considered alone or according to any technically possible combinations:

the turret includes 4(n+2) object holders, n being a natural integer;

the printing direction is substantially vertical;

the treatment units include a pretreatment unit, for example by plasma, and a drying unit, for example comprising a UV ray reactor;

the frame comprises at least two posts, the turret support respectively being connected to each of the posts by a pivot link along the pivot axis;

the turret support is in a cradle shape having a central portion on which the turret is mounted, and two end parts along the pivot axis respectively mechanically connected to the two posts;

the frame further comprises a beam mechanically connecting the two posts to form a gantry, the treatment units and the printing unit being attached on the beam; and the printing unit includes a support beam mounted to be height-adjustable relative to the frame, a carriage mounted sliding on the support beam along the pivot axis, a bearing bracket secured to the carriage, a board mounted on the bearing bracket, and a plurality of printheads mounted on the board.

The invention also relates to an assembly of a printing machine as described above, and a plurality of objects to be printed, each object having an outer surface substantially of revolution to be printed, in which the incline of the turret support is adjusted relative to the frame such that the outer surface of the object carried by the object holder located across from the printing unit has an upper generatrix substantially parallel to the alignment direction.

The invention also relates to a printing method for printing a plurality of objects, each object having an outer surface to be printed, including the following steps:

providing a frame, and at least two treatment units and at least one printing unit attached on the frame, the printing unit comprising at least one inkjet printhead, providing a turret support, and a turret mounted rotating on the turret support relative to the frame around a rotation axis, and comprising at least four object holders spaced regularly apart at 90° around the rotation axis, and suitable for holding the objects and rotating the objects around four object-holder axes, the object-holder axes being perpendicular to the rotation axis, moving the turret successively between at least four positions relative to the frame, at least one of the object holders being across from the printing unit in each of the positions, while two others of the object holders are across from the treatment units, ejecting inkjets via the printhead along a printing direction, the inkjets being aligned along an alignment direction perpendicular to the printing direction, and adjusting the incline of the turret support around a pivot axis relative to the frame, the pivot axis being, on the one hand, perpendicular to the object holder axis of the object holder located across from the printing unit, and, on the other hand, combined with the object holder axes of the other two object holders located across from the treatment units.

BRIEF DESCRIPTION OF THE DRAWINGS

The invention will be better understood upon reading the following description, provided solely as an example, and done in reference to the appended drawings, in which.

DETAILED DESCRIPTION

Figure 1:
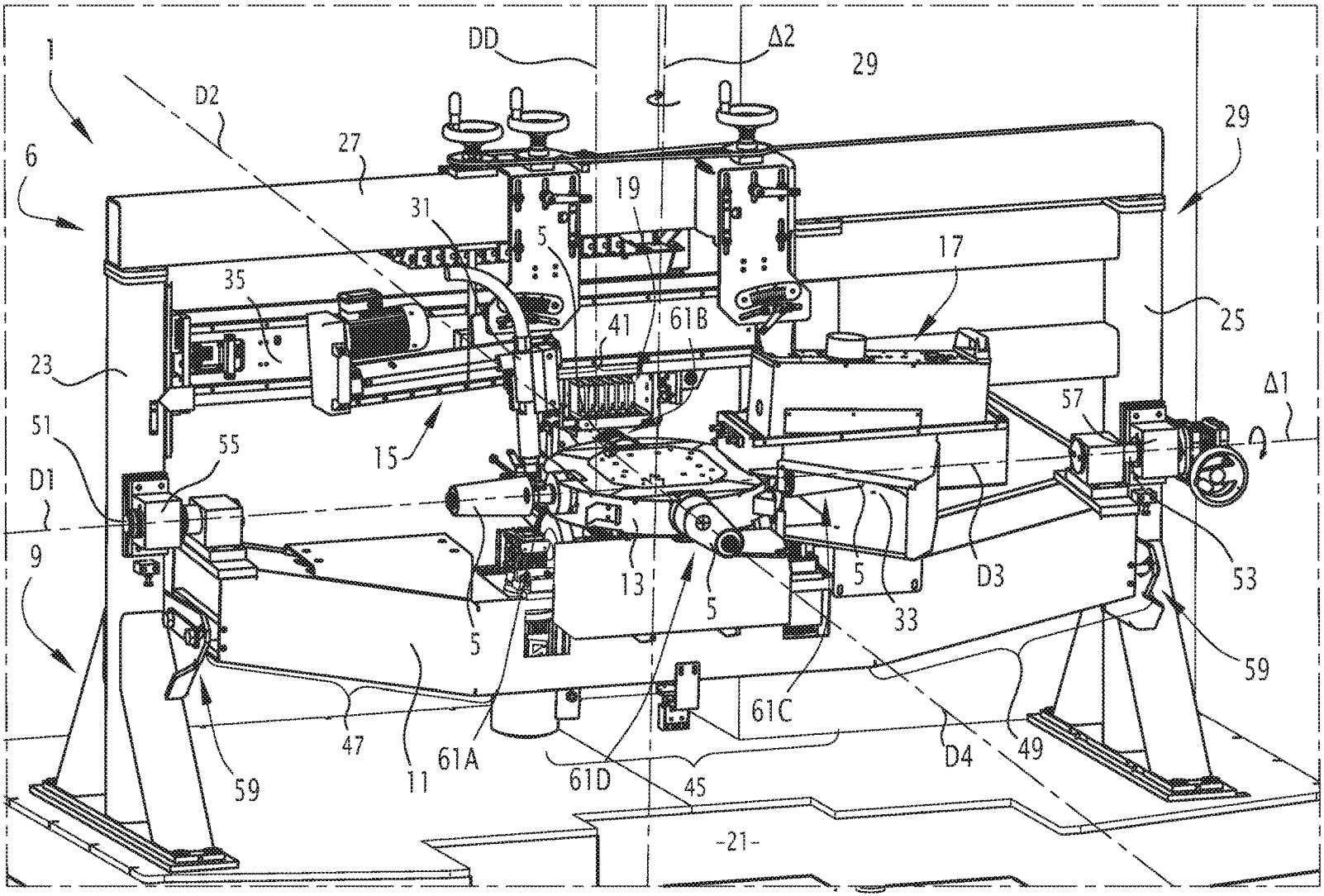
FIG. 1 is a perspective three-quarters view of an assembly according to the invention.
Figure 2:
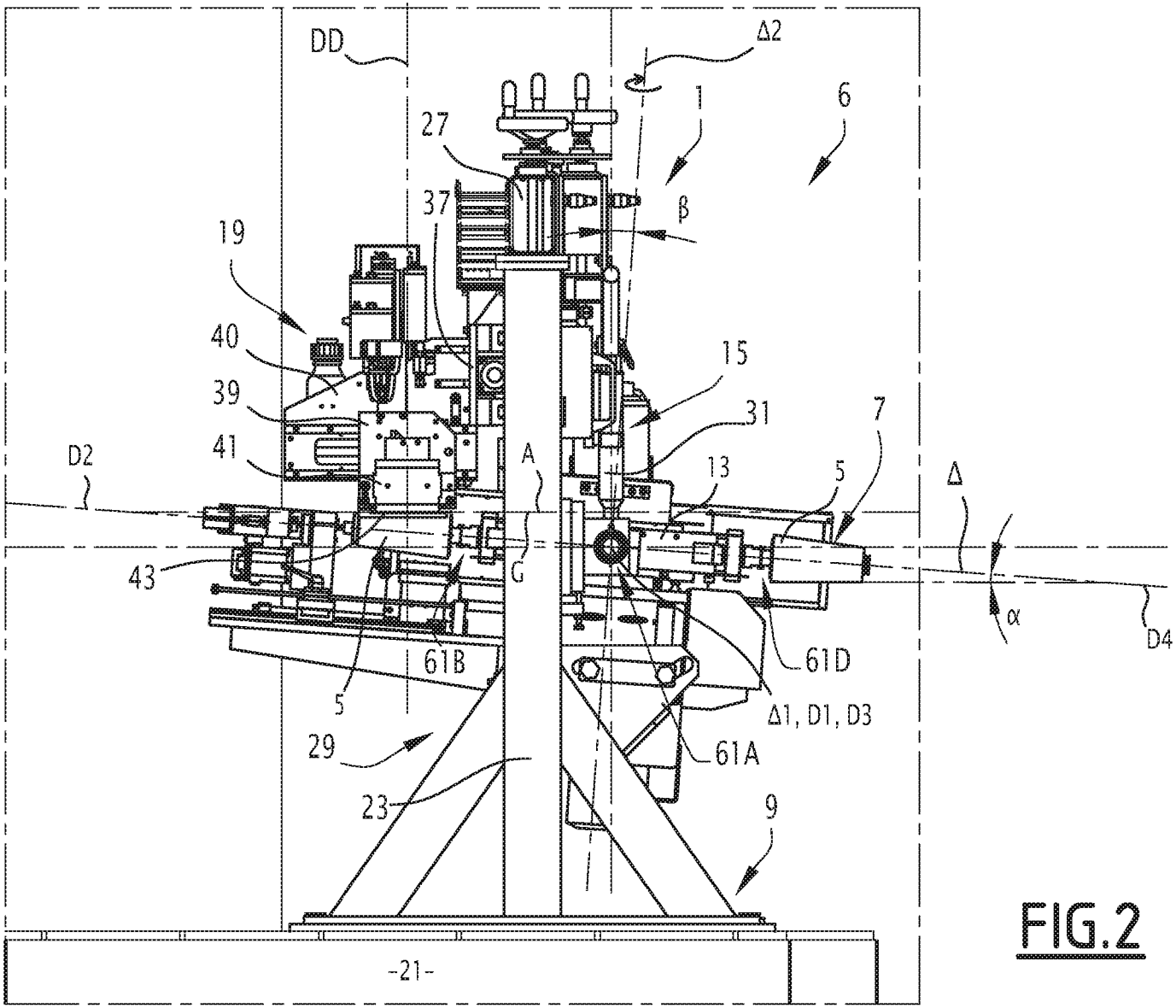
FIG. 2 is a side view of the assembly shown in FIG. 1.
Figure 3:
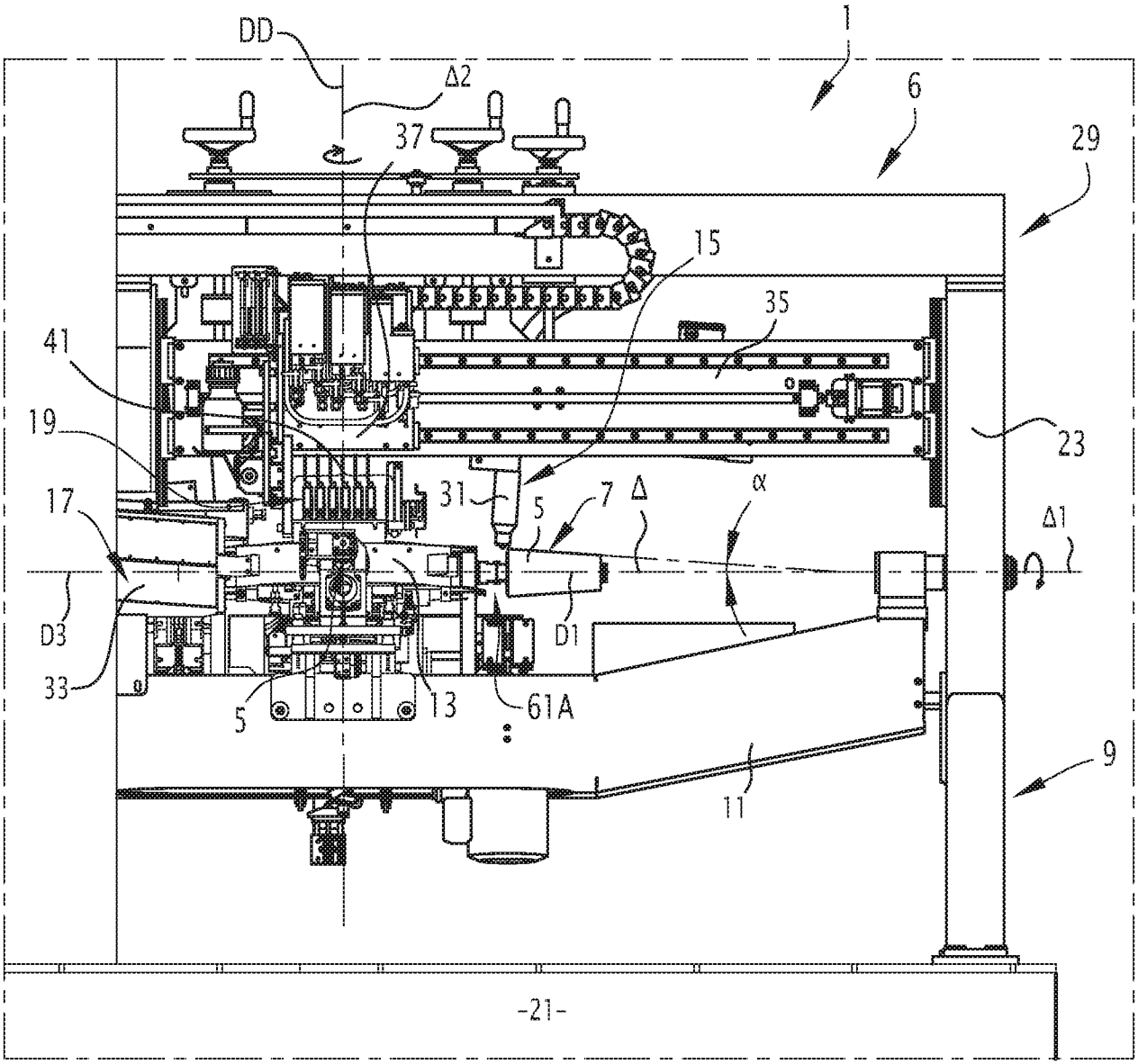
FIG. 3 is a partial rear view of the assembly shown in FIGS. 1 and 2.

An assembly 1 according to the invention is described in reference to FIGS. 1 to 3.

The assembly 1 includes a plurality of objects 5 to be printed, and a printing machine 6 for printing the objects.

The objects 5 are similar to one another. Each object 5 has an outer surface 7, for example substantially of revolution around an object axis Δ (FIGS. 2 and 3). Each object 5 is for example a bottle or a cup.

The outer surface 7 is for example frustoconical. The outer surface 7 forms an angle α with the object axis Δ that defines the taper of the objects 5.

The angle α is for example non-nil and less than or equal to 8.5°.

According to an alternative (not shown), the outer surface 7 is cylindrical. The angle α is then substantially nil.

According to still another alternative, the object 5 does not have an outer surface completely of revolution. For example, the object 5 comprises a handle (not shown).

According to still another alternative (not shown), the object 5 is an object, for example flat, having at least one planar surface to be printed.

The printing machine 6 includes a frame 9, a turret support 11 with an adjustable tilt around a pivot axis Δ1 relative to the frame, and a turret 13 mounted rotating and indexed relative to the frame around a rotation axis Δ2. The printing machine 6 also includes two treatment units 15, 17, and a printing unit 19 attached on the frame 9.

The frame 9 includes a base 21 placed or attached on a floor. The frame 9 also includes two posts 23, 25 and a beam 27 mechanically connecting the two posts to form a gantry 29.

The posts 23, 25 are advantageously vertical.

The beam 27 for example extends along the pivot axis Δ1, which is advantageously substantially horizontal.

The treatment units 15, 17 are for example attached on the beam 27 and adjustable in terms of position relative to the frame 9.

The treatment unit 15 is for example a plasma pretreatment unit and includes a plasma torch 31 suitable for being oriented toward one of the objects 5. The position of the treatment unit 15 is advantageously adjustable relative to the frame 9 so as to have an appropriate position relative to the turret 13.

The treatment unit 17 is for example a drying unit advantageously comprising a UV (ultraviolet) ray reactor 33.

The printing unit 19 includes a support beam 35 attached on the frame 9 and height-adjustable relative to the latter, a carriage 37 (FIGS. 2 and 3) mounted sliding on the support beam along the pivot axis Δ1, a board 39 secured to the carriage, and a plurality of inkjet printheads 41 mounted on the board 39 suitable for ejecting inkjets 43 along a printing direction DD on the outer surface 7.

In the illustrated example, there are six printheads 41, for example printing one of the bodies in the four-color photo printing type: yellow, magenta, cyan, black. Still in the illustrated example, two additional printheads make it possible to print in black for one, and to deposit a superposition varnish for the other.

According to an alternative that is not shown, the printing unit 19 only includes four printheads, for strict four-color printing, or even less. The printing direction DD is advantageously vertical.

Printheads 41 are similar to one another and of the type described in the preamble of this application, i.e., suitable for projecting the inkjets 43 from an ejection plane that is advantageously substantially horizontal, the inkjets 43 from a same printhead 41 forming rows extending along a substantially horizontal alignment direction A.

The printing unit 19 also includes drive members known in themselves and that will not be described in detail here, for adjusting the height of the printheads 41 relative to the frame 9, and moving the carriage 37 relative to the position of the support 35 along the pivot axis Δ1.

Advantageously, the board 39 bearing the printheads is mounted sliding on a bearing bracket 40 (FIG. 2) along the alignment direction A. This in particular makes it possible to print on objects 5 whereof the outer surface 7 has an extension greater than that of the printheads 41 along the alignment direction A.

The turret support 11 advantageously has a cradle shape (FIG. 1). The turret support 11 includes a central part 45 on which the turret 13 is mounted rotating around the rotation axis Δ2, and two end parts 47, 49 along the pivot axis Δ1 attached on the posts 23, 25.

Each of the end parts 47, 49 for example includes a cylindrical stud 51, 53 respectively movable in a fastener 55, 57 of the posts 23, 25.

The machine 6 also includes one or several members 59 for blocking the turret support 11 in a desired incline β around the pivot axis Δ1 relative to the frame 9.

The turret 13 includes four object holders 61A, 61B, 61C, 61D regularly spaced apart by 90° around the rotation axis Δ2 and suitable for holding the objects 5 and advantageously causing them to rotate respectively around four object holder axes D1, D2, D3, D4. The turret 13 is successively movable between four positions relative to the frame 9, which are deduced from one another by a 90° rotation around the rotation axis Δ2.

In the position shown in FIGS. 1 to 3, the object holder 61A holds one of the objects 5 across from the treatment unit 15. The object holder 61B holds another of the objects 5 across from the printing unit 19. The object holder 61C holds another of the objects 5 across from the treatment unit 17, i.e., in the reactor 33. Lastly, the object holder 61D is not located across from any treatment unit and allows the loading or unloading of the objects 5. Thus, the turret 13 is suitable for holding each of the objects 5 successively from a loading point toward an unloading point after having performed a complete revolution, passing below the treatment unit 15, then below the printing unit 19, and lastly in the treatment unit 17.

The object holder axes D1, D2, D3, D4 are for example respectively defined by a mandrel of the object holders 61A, 61B, 61C, 61D.

According to an alternative that is not shown, the object holder axes D1, D2, D3, D4 are defined by a cap and a tip of the object holders.

The object holder axes D1 to D4 are perpendicular to the rotation axis Δ2.

The axes of the object holders located across from the treatment units 15, 17, i.e. here the object holders 61A and 61C in the figures, coincides with the pivot axis Δ1.

According to an alternative that is not shown, the turret 13 comprises a number of object holders (not shown) of eight, twelve, etc., i.e. a multiple of four strictly greater than four, which may be written in the form 4(n+2), n being a natural integer. The object holders remain regularly angularly spaced apart around the rotation axis Δ2.

The pivot axis Δ1 remains perpendicular to the axis of the object holder holding the object 5 located across from the printing unit 19, and is combined with the two axes of the two object holders that are diametrically opposite relative to the rotation axis Δ2 and located across from the treatment units 15, 17. This makes it possible to implement additional treatment units (not shown), located angularly between any two consecutive object holders taken from among the object holders 61A to 61D shown in the figures.

The operation of the assembly 1 is deduced from its structure and will be briefly described hereinafter.

Based on the dimensions of the objects 5 to be printed, the relative positions of the treatment units 15, 17 and the printing unit 19 relative to the frame 9 are first adjusted.

Likewise, the incline β of the turret support 11 is advantageously adjusted so that an upper generatrix G of the object 5 held by the object holder located across from the printing unit 19 (here the object holder 61B) is parallel to the alignment direction A. In practice, the incline β is substantially equal to the angle α defining the taper of the objects 5.

In the alternative according to which the objects 5 are cylindrical, the turret 13 is advantageously not tilted, i.e., the rotation axis Δ2 is substantially vertical and the angle β is substantially nil.

In the alternative where the objects 5 have a planar face to be printed, the incline β is advantageously adjusted so that the planar face is substantially parallel to the alignment direction, and preferably substantially horizontal. In this case, each object 5 is advantageously kept immobile by the object holder in question across from the printing unit 19, and may receive several inks, for example four, in a single passage by the printing unit.

Then, traditionally, the objects 5 are successively loaded on the free object holder (the object holder 61D in the figures), while the object 5 held by the object holder 61A undergoes a pretreatment with plasma, the object 5 held by the object holder 61B undergoes successive printing operations by the printheads 41 of the printing unit 19, and the object 5 held by the object holder 61C undergoes drying in the ultraviolet treatment units 17.

When an object 5 returns where the object holder 61D is shown in the figures, after having undergone a complete printing cycle, the object is removed from its object holder, either manually or automatically.

Thus, each of the objects 5 is successively loaded on one of the object holders 61A to 61D, then brought opposite the treatment unit 15 by a 90° rotation of the turret 13 around a rotation axis Δ2 relative to the frame 9, then brought below the printheads 41 of the printing unit 19 by a new 90° rotation of the turret, next brought into the reactor 33 for drying by a new 90° rotation of the turret, and lastly brought back to its original position by a final 90° rotation of the turret, in which position it can be removed from its object holder.

Owing to the features described above, it is possible to adjust the incline of the object 5 located opposite the printing unit 19 through a prior adjustment of the incline β of the turret 11 around the pivot axis Δ1. Since the pivot axis Δ1 is combined with the axes of the object holders located opposite the two treatment units 15, 17, it is not necessary to modify the adjustment of the position of the treatment units after a modification of the incline β. Indeed, a modification of the incline β does not change the location of the object 5 located opposite these treatment units. The modification of the incline β of the turret 13 only causes a rotation of these objects 5 around themselves and does not affect the gap between these objects 5 and the treatment units 15, 17.

As a result, the adjustments of the printing machine 6 are simplified.

The invention claimed is:

1. A printing machine for printing a plurality of objects having an outer surface to be printed, the printing machine comprising:

a frame comprising at least two posts;

at least two treatment units;

at least one printing unit attached to said frame, the at least one printing unit comprising at least one inkjet printhead suitable for ejecting inkjets along a printing direction, and for the inkjets to be aligned along an alignment direction perpendicular to the printing direction;

a turret mounted rotating relative to said frame around a rotation axis, and comprising at least four object holders spaced regularly apart at 90° around the rotation axis, and suitable for holding the objects and rotating the objects around four object-holder axes, the object holder axes being perpendicular to the rotation axis, the turret being movable successively between at least four positions relative to said frame, at least one of said object holders being located across from said at least one printing unit in each of the positions, while two others of said object holders are located across from said at least two treatment units; and a turret support on which said turret is mounted rotating around the rotation axis, wherein an incline of the turret support is adjustable around a pivot axis relative to said frame, the pivot axis being, on the one hand, perpendicular to the object holder axis of the object holder located across from said at least one printing unit, and, on the other hand, coinciding with the object holder axes of the other two object holders located across from said at least two treatment units, and wherein the turret support is connected to each of said posts by a pivot link along the pivot axis.

2. The printing machine according to claim 1, wherein the turret includes n object holders, n being a natural integer.

3. The printing machine according to claim 1, wherein the printing direction is vertical.

4. The printing machine according to claim 1, wherein said at least two treatment units include comprise:

a pretreatment unit; and a drying unit.

5. The printing machine according to claim 4, wherein said pretreatment unit pretreats by plasma.

6. The printing machine according to claim 4, wherein said drying unit comprises a UV ray reactor.

7. The printing machine according to claim 1, wherein said turret support is in a cradle shape having a central portion on which said turret is mounted, and two end parts along the pivot axis respectively mechanically connected to said at least two posts.

8. The printing machine according to claim 1, wherein said frame further comprises a connecting beam mechanically connecting said at least two posts to form a gantry, said at least two treatment units and said at least one printing unit being attached on the connecting beam.

9. The printing machine according to claim 1, wherein said at least one printing unit comprises:

a support beam mounted to be height-adjustable relative to said frame;

a carriage mounted sliding on said support beam along the pivot axis;

a bearing bracket secured to said carriage;

a board mounted on said bearing bracket; and a plurality of printheads mounted on said board.

10. An assembly of a printing machine according to claim 1, and a plurality of objects to be printed, each object having an outer surface of revolution to be printed, in which the incline of said turret support is adjusted relative to said frame such that the outer surface of the object carried by the object holder located across from said at least one printing unit has an upper generatrix parallel to the alignment direction.

* * * * *